US005462830A

United States Patent [19]

Kubota et al.

[11] Patent Number: 5,462,830

[45] Date of Patent: Oct. 31, 1995

[54] RESIN COMPOSITION FOR A TONER FOR AN ELECTROPHOTOGRAPHY AND THE TONER COMPRISED THE SAME

[75] Inventors: Hideyuki Kubota; Mitsuaki Horiike, both of Shizuoka; Toshiharu Furukawa, Suita, all of Japan

[73] Assignees: Tomoegawa Paper Co., Ltd., Tokyo; Sekisui Chemical Co., Ltd., Osaka, both of Japan

[21] Appl. No.: 357,276

[22] Filed: Dec. 13, 1994

[30] Foreign Application Priority Data

Dec. 13, 1993 [JP] Japan ..... 5-341175

[51] Int. Cl.[6] ..... G03G 9/097

[52] U.S. Cl. ..... 430/110

[58] Field of Search ..... 430/110

[56] References Cited

U.S. PATENT DOCUMENTS 4,287,282 9/1981 Miyakawa et al. ..... 430/110 X 4,329,415 5/1982 Ikeda et al. ..... 430/109

4,758,491 7/1988 Alexandrovich et al. ..... 430/110

5,074,123 1/1992 Nanya et al. ..... 430/110 X

FOREIGN PATENT DOCUMENTS 4361271 12/1992 Japan .

6289644 10/1994 Japan .

*Primary Examiner*—Roland Martin

*Attorney, Agent, or Firm*—Oblon, Spivak, McClelland, Maier & Neustadt

[57] ABSTRACT

A resin composition for a toner comprising a polymer made of styrene/(meth)acrylic ester copolymers, a thermoplastic polyesterurethane resin having a weight average molecular weight in a range of 5,000 to 500,000, and a vegetable wax having a melting point in a range of 65° to 90° C.

4 Claims, No Drawings

RESIN COMPOSITION FOR A TONER FOR AN ELECTROPHOTOGRAPHY AND THE TONER COMPRISED THE SAME

BACKGROUND OF THE INVENTION

Field of the Invention

The present invention relates to a toner for electrophotography. Specifically, the present invention relates to a resin composition used in the toner for electrophotography which is used in printers or coelectrophotography machines utilizing heat-roll fixing.

Recently, various improvements or modifications on coelectrophotography machines or printers utilizing electrophotography have been desired as these machines became more popular. For example, it has been desired to achieve a low energy consumption in order to find their way into homes. It is also desirable to make the machines run at high speeds with a view to promoting the spread of the machines into so called gray areas positioned at a border line between printers and copiers. It is also necessary to simplify the structure of the machine in order to reduce the cost of the machines.

Moreover, it has become popular to use the machines having functions of printing on both sides of the printed sheet and delivering the printed sheet automatically.

Of the above-described requirements, particularly desired is a toner for electrophotography (hereafter, referred to simply as "toner") having a lower fixing temperature, a good anti-offset quality and fixing strength so that spots are not generated in a printed sheet in printing both sides of the printed sheet.

The toner used widely from the past has the following composition.

Binder resin: 80–90 parts by weight

Pigment: 5–15 parts by weight

Charge Controlling Agent: 0.5–5 parts by weight

Additives (for example, Cleaning Agent, Fluidizer): 0.1–1 parts by weight

It is clear from the above composition that most components comprising the toner are binder resins. Properties of the toner are influenced by the properties of the binder resin. Therefore, it is understood easily that the properties of the toner can be controlled by controlling the properties of the binder resin.

In order to give a good low temperature fixing property to the toner, it is preferable to use the binder resin having a lower molecular weight. By using a resin having a lower molecular weight as a binder resin, the fixing property at low temperatures can be improved; however, an offset phenomena can occur easily, and toner particles are easily coagulated with each other. Therefore a shelf life of the toner becomes worse.

Another means to solve the problems, for example, is to add a material having a low melting point. However, the same problems as above were encountered.

A Japanese Patent Application First Publication H4-361271 discloses a means of using thermoplastic polyesterurethane resin and vinyl copolymer, as one of the means to solve the problems. Thermoplastic polyesterurethane resin has urethane bonding at the end thereof, and the urethane bonding includes nitrogen atoms. Therefore a polarity of the toner comprising thermoplastic polyesterurethane resin becomes easily positive. When thermoplastic polyesterurethane resin is added to a negatively charged toner, there are cases when the negative charge of the toner becomes weak when the toner is used for a long time. Consequently, smudging is easily generated in a printed paper. In contrast, when thermoplastic polyesterurethane resin is added to the positively charged toner, there are cases when the positive charge property becomes stronger, therefore the image density decreases.

A Japanese Patent Application First Publication H6-289644 discloses a means of using a vegetable wax to provide a toner having a good fixing property even at lower temperatures. In general, the vegetable wax comprised wax ester, free fatty acid, and a minor alcohol component. The minor alcohol component is oxidated in a heating step of preparing the toner, therefore activated polar groups are generated. When the activated polar groups exist, frictional electrification of the toner used over a long time becomes unstable. Therefore an image density becomes lower. That is, the toner comprised of vegetable wax has a problem in image properties.

SUMMARY OF THE INVENTION

According to a first aspect of the present invention, a resin composition comprising a polymer made of styrene/(meth-)acrylic ester copolymers, a thermoplastic polyesterurethane resin having a weight average molecular weight in a range of 5,000 to 500,000, and a vegetable wax having a melting point in a range of 65° to 90° C.

According to a second aspect of the present invention, a toner for electrophotography comprises said resin composition as claimed in claim 1 and additives.

PREFERRED EMBODIMENTS

In the following, preferred embodiments of the resin composition used to make the toner of the present invention will be presented. The sequence of presentation is: a description of the styrene/(meth)acrylic ester copolymers used in making the resin; a description of the thermoplastic polyesterurethane resin; and a description of the vegetable wax.

The method of making the resin composition is presented, and experimental example of making resin compositions and the toners containing the resin compositions are presented, and the performances of the present resin compositions and the toner are evaluated and compared with the conventional resin compositions and the toners.

The styrene/(meth)acrylic ester copolymer can be obtained by copolymerizing styrene monomer and acrylic ester monomer.

The acrylic ester monomers are, for example, methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chlorethyl acrylate, phenyl acrylate, methyl α-chloracrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, diethylaminoethyl methacrylate and the like.

The thermoplastic polyesterurethane resin is an elastomer having urethane bonds, and has a linear chain form. The thermoplastic polyesterurethane resin can be obtained by allowing diisocyanate to react with a saturated polyester. The saturated polyester can be obtained by allowing polybasic acid having carboxyl group of more than 2 to polycondense with a dihydric alcohol. In reacting diisocyanate with saturated polyester, it is preferably to choose a mixing ratio between them so as to be approximately equaled a molar concentration of the activated hydroxyl group included in saturated polyester and that of the isocyanate group included in diisocyanate.

The polybasic acids having carboxyl group of more than 2 are, for example, adipic acid, azelaic acid, sebacic acid, dodecanoic diacid, terephthalic acid, isophthalic acid, phthalic acid, succinic acid, and the like.

The dihydric alcohols are, for example, ethylene glycol, 1,2-propylene glycol, 1,4-butane diol, 1,6-hexane diol, neopentyl glycol, diethylene glycol, triethylene glycol, polyethylene glycol, propylene glycol, polycaprolactone, and the like.

The diisocyanates are, for example, tolylenediisocyanate, diphenylmethanediisocyanate, hexamethylenediisocyanate, xylenediisocyanate, cyclohexylmethanediisocyanate, and the like.

A weight average molecular weight of the thermoplastic polyesterurethane resin must be in a range of 5,000 to 500,000. When the weight average molecular weight is less than 5,000, a good tough property cannot be obtained. In contrast, when it is more than 500,000, the resin composition and the toner includes gel component at a high percentage, therefore a fixing property becomes worse.

The weight average molecular weight and a peak value of molecular weight distribution were measured by Gel Permeation Chromatography (GPC). The conditions of measurement are as below.

column temperature: 40° C.

solvent: tetrahydrofuran current speed: 1 mm/min sample concentration: 0.2% sample amount: 100 μl column: KF-80M x 2 (marketed by Shodex Co.)

KF-802.5 (marketed by Shodex Co.)

A melting point of the vegetable wax must be in a range of 65° to 90° C. Rice wax, carnauba wax, haze wax, candelira wax and the like are used in the present invention. When the melting point of the vegetable wax is less than 65° C., the vegetable wax comprised of the toner becomes easily meltable. Therefore, the toners comprising said vegetable waxes are coagulated each other. That is, a shelf life property of the toner becomes worse. In contrast, the melting point of the vegetable wax is more than 90° C., producing an effect that a start point of softening of the toner comprising the waxes cannot sufficiently be lowered. It is preferable to use the vegetable wax having a melting point less than 85° C.

In the present specification, "a melting point" means a peak temperature of a heat absorbing curve obtained by Differential Scanning Calorimeter (DSC).

It is most preferable to choose a mixing ratio between the thermoplastic polyesterurethane resin and the vegetable wax so a mole ratio is 1:1 between the isocyanate groups positioned at the end of molecules of the thermoplastic polyesterurethane resin and the hydroxyl group of the alcohol included at a small amount in the vegetable wax. However, a content of alcohol is indefinite, because it depends upon many factors such as a chain length of the used vegetable wax and the like. Therefore, it is difficult to achieve said ratio of 1:1. In the present invention, the preferable mixing ratio between the thermoplastic polyesterurethane resin and the vegetable wax is set between 1:0.5–5.

The resin composition is preferably comprised of 100 parts by weight of styrene/(meth)acrylic ester copolymer, a range of 0.5 to 20 parts by weight of thermoplastic polyesterurethane resin and a range of 1 to 25 parts by weight of vegetable wax. When the amounts of thermoplastic polyesterurethane resin and vegetable wax are less than 0.5 and 1 parts by weight respectively, a good fixing property at low temperature cannot be obtained. In contrast, those toners having more than 20 and 25 parts by weight respectively, the offset phenomena to a fixing roller becomes easily generatable, that is, the obtained toner easily attaches to the fixing roller.

In the present invention, beside the styrene/(meth)acrylic ester copolymer, the thermoplastic polyesterurethane resin and the vegetable wax, styrene resin, polyacrylic resin, vinyl chloride, poly (vinyl acetate), poly (vinylidene chloride), epoxy resin, polyester resin, and the like can be mixed in the resin composition.

The resin composition can be obtained by solution polymerizing styrene/(meth)acrylic ester copolymers under the presence of the thermoplastic polyesterurethane resin having an average molecular weight in a range of 5,000 to 500,000, and vegetable wax having a melting point in a range of 65° to 90° C.

A dispersiblity of the thermoplastic polyesterurethane resin and the vegetable wax to the styrene/(meth)acrylic ester copolymer is improved by employing the manufacturing process. Moreover, the dispersiblity of the vegetable wax to a binding resin is also improved. Therefore, desorption of the vegetable wax from the toner can be prevented. Consequently, image properties of the toner are improved. Moreover, a reaction between isocyanate groups of the thermoplastic polyesterurethane resin and the alcohol component of the vegetable wax is promoted. Therefore, a charge property of the toner become stable.

The toner of the present invention is comprised of said resin composition and additives.

The additives are, for example, pigment, charge controlling agent, magnetic powder, and the like. Representative examples of said pigment include, carbon black, aniline black, phthalocyanine blue, quinoline yellow, malachite green, lamp black, rhodamine-B, quinaclidone, and the like. In generally, the pigment are added to the resin composition at a ratio of 1–20% to 100% by weight.

The charge controlling agents are classified into a positive charge controlling agent and a negative charge controlling agent. The positive charge controlling agent is, for example, nigrosine dye, ammonium salt, pyridinium salt, azine and the like. The negative charge controlling agent is, for example, chrome complex, iron complex, and the like. In generally, the charge controlling agents are added to the resin composition at a ratio of 0.1–10% to 100% by weight.

The toner of the present invention can be obtained by dispersing and mixing the resin composition and the additives, if necessary, heating and pulverizing them.

In the resin composition used in the toner comprising it of the present invention, the isocyanate group positioned at the end of the thermoplastic polyesterurethane resin and the alcohol component of the vegetable wax are reacted, therefore the generation of activated polar groups is prevented. Consequently, the toner of the present invention has a stable charge property. Moreover, the both compounds have ester bonds, and were good solubility with each other. Therefore, the desorption of the vegetable wax from the toner is prevented, and the anti-offset property at high temperature is improved. Moreover, electrons included in the toner can move easily, and a biasness of a polarity of the toner is hardly developed. Consequently, a stable frictional electrification and a image having a high image density after a plurality printings test can be obtained.

EXPERIMENTAL EXAMPLE

The following are experimental examples based on the resin composition and the toner embodiments of the present invention presented above.

In Examples, "parts" mean "parts by weight".

[Example 1]

Producing a resin composition 15 parts of styrene/acrylic ester copolymer having a peak of value of molecular weight distribution of 500,000 obtained by polymerizing 12 parts of Styrene and 3 parts of n-butyl acrylate, 4 parts of thermoplastic polyesterurethane resin having a weight average molecular weight of ca. 100,000 (trade name: Desmocall 110, marketed by Sumitomo Bayer Uretane Co.), parts of rice wax (melting point: 81° C., trade name: rice wax, marketed by NODA WAX Co.), 50 parts of xylene were inputed and dissolved in flask. The composition was heated to the boiling point of xylene under $N_2$ gas.

Styrene and n-butyl acrylic ester copolymer were solution polymerized by dropping a mixed solution comprised of 63 parts of styrene, 12 parts of n-butyl acrylate, and 3 parts of benzoyl peroxide (as polymerization initiator) for 2 hours and mixing while refluxing in xylene. After dropping all the mixed solution, the styrene and n-butyl acrylate copolymer were aged for 1 hour in refluxing xylene. After that, the resin composition was obtained by removing xylene by raising the temperature gradually to 180° C. with a decompression. The obtained resin composition A of the present embodiment had two molecular peaks at 10,000 and 500,000.

Producing a toner comprising the obtained resin composition 100 parts of the obtained resin composition A, 1.5 parts of a chromium-containing dye (trade name: S-34, marketed by Orient Chemical Industries Co.), and 6.5 parts of carbon black (trade name: MA-100, marketed by Mitsubishi Kasei Co., LTD) were mixed and heating. The particle having an average diameter of 12 μm was obtained by pulverizing the heated mixture by jet mill. A toner of the present Example was obtained by adding 0.3 parts of hydrophobic silica (trade name: R972, marketed by Nippon Aerosil) to 100 parts of the obtained particle.

[Example 2]

A resin composition B was prepared in the same way as in Example 1, except that the thermoplastic polyesterurethane resin having a weight average molecular weight of ca. 100,000 (trade name: Desmocall 110, marketed by Sumitomo Bayer Urethan Co.) was replaced with thermoplastic polyesterurethane resin having a weight average molecular weight of ca. 200,000 (trade name: Bantex T-5210, marketed by: Dainippon Inki Chemical Industries, Co., LTD).

A toner of the present Example, using said resin composition B instead of the resin composition A of the Example 1, was thus obtained.

[Example 3]

A resin composition C was prepared in the same way as in Example 1, except that 4 parts of the thermoplastic polyesterurethane resin having a weight average molecular weight of ca. 100,000 (trade name: Desmocall 110, marketed by Sumitomo Bayer Uretane Co.), and 6 parts of rice wax were respectively replaced with 5 parts of that and 5 parts of candelira wax (trade name: candelira refine, marketed by: Mitsuba Trading Co.).

A toner of the present Example, using said resin composition C instead of the resin composition A of the Example 1, was thus obtained.

[Comparative Example 1]

A resin composition D was prepared in the same way as in Example 1, except that the thermoplastic polyesterurethane resin having a weight average molecular weight of ca. 100,000 (trade name: Desmocall 110, marketed by Sumitomo Bayer Uretane Co.), and rice wax were not added.

A toner D of the present Comparative Example, using said resin composition D instead of the resin composition A of the Example 1, was thus obtained.

[Comparative Example 2]

A resin composition E was prepared in the same way as in Example 1, except that the rice wax was not added.

A toner E of the present Comparative Example, using said resin composition E instead of the resin composition A of the Example 1, was thus obtained.

[Comparative Example 3]

A resin composition F was prepared in the same way as in Example 1, except that the thermoplastic polyesterurethane resin was not added.

A toner F of the present Comparative Example, using said resin composition F instead of the resin composition A of the Example 1, was thus obtained.

[Comparative Example 4]

Thermoplastic polyesterurethane resin having a weight average molecular weight of ca. 3,000 was obtained by allowing 1 mol of polyester having a weight average molecular weight of 1,000 to react with 0.66 mol of tolylenediisocyanate. Said polyester was obtained by reacting adipic acid with 1,6-hexanediol.

A resin composition G was prepared in the same way as in Example 1, except that the thermoplastic polyesterurethane resin having a weight average molecular weight of ca. 100,000 (trade name: Desmocall 110, marketed by Sumitomo Bayer Uretane Co.) was replaced with that having a weight average molecular weight of ca. 3,000.

A toner G of the present Comparative Example used said resin composition G instead of the resin composition A of the Example 1.

[Comparative Example 5]

Thermoplastic polyesterurethane resin having a weight average molecular weight of ca. 600,000 was obtained by allowing 1 mol of polyester having a weight average molecular weight of ca. 40,000 to react with 1 mol of totylenediisocyanate. Said polyester was obtained by reacting adipic acid with 1,6-hexanediol.

A resin composition H was prepared in the same way as in Example 1, except that the thermoplastic polyesterurethane resin having a weight average molecular weight of 100,000 (trade name: Desmocall 110, marketed by Sumitomo Bayer Uretane Co.) was replaced with that having a weight average molecular weight of ca. 600,000.

A toner H of the present Comparative Example used said resin composition H instead of the resin composition A of the Example 1.

[Comparative Example 6]

A resin composition I was prepared in the same way as in Example 1, except that rice wax (melting point: 81° C., trade name: rice wax, marketed by NODA WAX Co.) was replaced with haze wax (melting temperature: 55° C., trade name: Mokurou-100, marketed by NODA WAX Co.).

A toner I of the present Comparative Example, using said resin composition I instead of the resin composition A of the Example 1, was thus obtained.

The following evaluation tests were performed on the obtained toner in Examples and Comparative Examples.

(1) Non Offset-Temperature Range, and Non Offset-Temperature Width

Two component developers were obtained, which is comprised of 4 parts of the obtained toners in Examples and Comparative Examples and 96 parts of non-coated Ferrite carrier (trade name: FL-1020, marketed by Powder Teck Co.). The obtained developers were used to produce stripe test patterns of 20 mm×50 mm size on A4 size printing paper using a copying machine (trade name: SF-9800, marketed by SHARP Co.).

Next, a fixing device having a thermal fixing roll whose surface is covered with fluorine-contained resin, and a press fixing roll whose surface is covered with silicone were used to fix the above unfixed test patterns. The fixing conditions were: pressure of the press fixing roll at 10 g/mm$^2$, roll speed at 100 mm/sec. The temperature of the surface of the thermal fixing roll was made to rise gradually. A temperature range that no toner smudging was observed in a white margin of the printing sheet was defined as an Non Offset-Temperature Range. A difference of temperature between the lowest temperature and the highest temperature in the Non Offset-Temperature Range was defined as an Non Offset-Temperature Width.

(2) Fixing Strength

The unfixed test patterns were fixed by using the thermal fixing roll whose temperature of surface being 150° C. and 170° C. The image densities of the fixed test patterns were measured, after rubbing them with cotton pads under a constant rubbing pressure. The image densities were measured by an illuminameter (trade name: RD-914, marketed by Machbeth).

The fixing strength, in %, was determined according to the following mathematical expression, (After-rubbing strength/as-fixed strength)×100

(3) Image Properties 20,000 printings were produced with a copying machine (trade name: SF-9800, marketed by Sharp) in which the two component developers comprising the obtained toners in the above item (1) were supplied. Amounts of frictional electrification, image densities, and smudgings of the white parts are evaluated after 1 printing, 10,000 printings, and 20,000 printings. The printing tests used A4 size printing paper. The black/white ratio in the obtained printed paper was 10/90.

The amount of frictional electrification was evaluated by Brow-off measurement equipment (trade name: TB-200, marketed by Toshiba Chemical Co., Ltd.).

The image density was evaluated by an illuminameter (trade name: RD-914, marketed by Machbeth).

The smudging was evaluated by color-difference meter (trade name: Z-1001DP, marketed by Nippon Dennsyoku Industrial Co.,).

(4) Shelf Life Properties 20 g of the toners obtained in Examples and Comparative Examples were stored, placed in a polyethylene bottle of 150 cc. The bottle was closed, and was it at 50° C. for 48 hours. After that, the toners were put on a white paper, for observation of the toner condition.

The evaluation results are reported by placing an "O" for those toners which did not show any changes, compared with before testing state and by placing an "X" for those toners which agglomerated.

The results of evaluation testing are summarized in Tables 1 and 2.

It is clear from Tables 1 and 2 that the Non Offset-Temperature Widths of the toners in Examples were wider than those in Comparative Examples. The toners of the Examples have width such as 75°–80° C., and the fixing strength at 150° C. were more than 65%. Therefore the toners of the Examples can be used practically.

Moreover, the results of the tests such as amounts of frictional electrification of −21 to −23 μc/g, the image densities of 1.35 to 1.39, and the smudging of less than 0.70 also show that the toners of Examples can be used in practical uses.

In contrast, the fixing strength of the toner D in Comparative Example 1 comprising the resin composition D was lower, such as 46% at 150° C., therefore it becomes clear that said toner D has a problem of fixing property at lower temperature.

Moreover, the amount of frictional electrification of the toner E in Comparative Example 2 comprising the resin composition E was lower, and the smudging was greater than 1.0 at 20,000 printings, therefore it becomes clear that said toner E has a problem of fixing strength in practice, and it was confirmed that this toner has a lower fixing strength than the toner A in Example 1 at 150° C.

The amount of frictional electrification of the toner F in Comparative Example 3 comprising the resin composition F was greater such as −34.5 μc/g and the image density of that was much lower than 1.0 at 20,000 printings. It is confirmed that the image property thereof is worse, and the toner F cannot use practically. Moreover, the fixing strength of said toner F was lower than that of the toner in Example 1 at 150° C.

The fixing strength of the toner G in Comparative Example 4 comprising the resin composition G was lower such as 55% at 150° C. Therefore, it becomes clear that said toner G has a problem of fixing property at lower temperature as compared with the toner of Example 1.

The fixing strength of the toner H in Comparative Example 5 comprising the resin composition H was lower, such as 57% at 150° C. Moreover, the lowest temperature of the Non Offset-Temperature range is 145° C. That value is higher than that of the Non Offset-Temperature range of the toner H in Example 1. Therefore, it becomes clear that said toner H has a problem of fixing property at lower temperature.

The toner I in Comparative Example 6 comprising the resin composition I has a problem of a shelf life property.

TABLE 1

| | No. | Non Offset-Temperature Range (°C.) | Non Offset-Temperature Width (°C.) | Fixing Strength (%) 150° C. | Fixing Strength (%) 170° C. | Frictional electrification (μc/g) 1 printing | Frictional electrification (μc/g) 10,000 printings | Frictional electrification (μc/g) 20,000 printings |
|---|---|---|---|---|---|---|---|---|
| Example | 1 | 135~215 | 80 | 66 | 75 | −21.5 | −22.6 | −22.0 |
| | 2 | 135~215 | 80 | 66 | 76 | −21.1 | −21.8 | −22.4 |
| | 3 | 135~210 | 75 | 65 | 72 | −21.7 | −21.0 | −21.8 |
| Comparative Example | 1 | 150~200 | 50 | 46 | 58 | −22.0 | −22.4 | −21.8 |
| | 2 | 140~190 | 50 | 59 | 67 | −19.4 | −15.1 | −13.2 |
| | 3 | 140~215 | 75 | 60 | 68 | −20.6 | −29.8 | −34.5 |
| | 4 | 135~200 | 65 | 55 | 61 | −21.5 | −20.8 | −20.6 |
| | 5 | 145~215 | 70 | 57 | 65 | −20.9 | −21.5 | −20.6 |
| | 6 | 135~210 | 75 | 68 | 76 | −21.4 | −22.3 | −20.5 |

TABLE 2

| | No. | Image Density 1 printing | Image Density 10,000 printing | Image Density 20,000 printing | Smudge 1 printing | Smudge 10,000 printing | Smudge 20,000 printing | Shelf Life |
|---|---|---|---|---|---|---|---|---|
| Example | 1 | 1.37 | 1.35 | 1.36 | 0.46 | 0.61 | 0.57 | ○ |
| | 2 | 1.39 | 1.36 | 1.37 | 0.42 | 0.56 | 0.60 | ○ |
| | 3 | 1.38 | 1.35 | 1.35 | 0.48 | 0.62 | 0.58 | ○ |
| Comparative Example | 1 | 1.37 | 1.35 | 1.35 | 0.38 | 0.51 | 0.53 | ○ |
| | 2 | 1.37 | 1.42 | 1.45 | 0.53 | 0.82 | 1.15 | ○ |
| | 3 | 1.38 | 1.15 | 0.98 | 0.42 | 0.44 | 0.41 | ○ |
| | 4 | 1.37 | 1.39 | 1.40 | 0.50 | 0.64 | 0.74 | ○ |
| | 5 | 1.36 | 1.35 | 1.37 | 0.48 | 0.59 | 0.64 | ○ |
| | 6 | 1.35 | 1.35 | 1.37 | 0.50 | 0.66 | 0.70 | x |

What is claimed is:

1. A resin composition for a toner comprising a polymer made of styrene/(meth)acrylic ester copolymers, a thermoplastic polyesterurethane resin having a weight average molecular weight in a range of 5,000 to 500,000, and a vegetable wax having a melting point in a range of 65° to 90° C.

2. A resin composition for a toner as claimed in claim 1, wherein said resin composition is prepared by solution polymerizing styrene/(meth)acrylic ester copolymers under the presence of said thermoplastic polyesterurethane resin having a weight average molecular weight in a range of 5,000 to 500,000, and said vegetable wax having a melting point in a range of 65° to 90° C.

3. A resin composition for a toner as claimed in claims 1 or 2, wherein said resin composition is comprised of 100 parts by weight of styrene/(meth)acrylic ester copolymers, a range of 0.5 to 20 parts by weight of thermoplastic polyesterurethane resin and a range of 1 to 25 parts by weight of said vegetable wax.

4. A toner for electrophotography comprising said resin composition as claimed in claim 1, 2 or 3.

* * * * *